United States Patent [19]

Miller et al.

[11] Patent Number: 5,020,243

[45] Date of Patent: Jun. 4, 1991

[54] DRYER SYPHON

[75] Inventors: George B. Miller, North Vancouver; John G. Sanderson, Burnaby, both of Canada

[73] Assignee: MacMillan Bloedel Limited, Burnaby, Canada

[21] Appl. No.: 444,242

[22] Filed: Dec. 1, 1989

[51] Int. Cl.[5] ..... F26B 13/08

[52] U.S. Cl. ..... 34/119; 34/124

[58] Field of Search ..... 34/119, 124, 125; 165/86-90

[56] References Cited

U.S. PATENT DOCUMENTS 4,384,412 5/1983 Chance et al. .
4,516,334 5/1985 Wanke .
4,606,136 8/1986 Pflug .
4,718,177 1/1988 Haeszher .

OTHER PUBLICATIONS

'A Model for Predicting Regime Transition in Horizontal and Near Horizontal Gas-Liquid', AlChe Journal (vol. , No. 1), Jan. 1976, pp. 47-54, Taitel and Dukler of the Department of Chemical Engineering, University of Houston.

'A Study of Two-Phase Flow in Inclined Pipes', Beggs et al., Journal of Petroleum Technology, May 1973, pp. 607-617.

*Primary Examiner*—Henry A. Bennett
*Attorney, Agent, or Firm*—C. A. Rowley

[57] ABSTRACT

The perimeter and height of an inlet gap to a dryer syphon shoe (for a steam heated dryer drum) are selected to provide an area which at maximum design condensate flow rate accommodates both condensate and steam flows and in proportions and at speeds that will ensure distributed flow of the steam and condensate while maintaining efficient dryer operation. A plate is positioned inside of the shoe and combines with an inside wall of the shoe to define a transition passage leading from the gap wherein flow is axial of the drum to the condensate return pipe where flow is substantially radial of the drum. The transition passage has a cross sectional area measured substantially perpendicular to the direction of flow that is substantially equal to or less than the area of the inlet gap, provides a smooth transition for the flow between the gap and the condensate return pipe and insures distributed flow through the syphon.

13 Claims, 4 Drawing Sheets

DRYER SYPHON

FIELD OF THE INVENTION

The present invention relates to a dryer syphon. More specifically the present invention relates to a shoe having a gap and a transition passage both sized and shaped to insure distributed flow of condensate and steam from the inlet gap to a condensate return conduit.

BACKGROUND OF THE INVENTION

Generally paper machine dryers (for which the present invention is particularly useful) are steam heated and are divided into a plurality of different dryer sections each composed of a number of dryer drums (cans) connected in parallel to a source of steam at a preselected pressure (temperature). In each drum the steam condenses thereby forming condensate and releasing heat for drying the paper. The released heat is transferred to the wet paper passing over the outside of the drum through the layer of condensate formed in the drum and the drum shell. The heat transfer rate through the condensate layer is about 8 to 10 times less than the rate through the shell of the dryer drum. Thus for efficient heat transfer (paper drying) the depth of the condensate layer inside the rotating drum (known as the rimming depth) should be maintained as small as is practical. In modern machines the rimming depth is about 1/16 inch.

The condensate is removed from each of dryer cans via a dryer syphon which consists of a shoe and a syphon pipe. Some steam also enters the dryer syphon with the condensate. This steam is known as blow through steam and assists the removal of the condensate. The steam and condensate from each dryer can discharge to a return header which in turn discharges to a separator tank. In this tank, the steam and condensate are separated. The condensate is removed from the tank by the condensate pump working on level control and is pumped to the steam plant. The blow through steam leaves the top of the tank and is piped to the suction side of a thermo compressor. The blow through steam, at a lower pressure than the supply steam is entrained by the motive steam entering the thermo compressor at a higher pressure than the supply steam and is discharged at the preselected supply steam pressure. The discharge steam from the thermo compressor consisting of the sum of the blow through steam and the motive steam, plus any make up steam, constitutes the supply steam required by the dryer section. The ratio of the mass flow of suction (blow through) steam to the mass flow of the motive steam is known as the entrainment ratio. For any given motive steam pressure and supply steam pressure, the entrainment ratio will decrease as the difference between the supply steam pressure and suction steam pressure increases. If the thermo compressor is unable to entrain all the blow through steam, (i.e. the pressure of the blow through steam is low as determined primarily by the pressure drop required to carry the condensate from the drum) the excess low pressure blow through steam (blow down steam) is discharged through the blow down valve and condensed and the steam required by the dryer section is met by increasing the amount of make up steam. It is thus evident that to minimize blow down, the entrainment ratio of the thermo compressor should be high and thus the difference in pressure between the supply steam and suction steam (pressure differential) should be maintained as small as possible.

The pressure loss caused by the flow of steam and condensate through the dryer system as a result of overcoming friction and centrifugal force (pressure drop for condensate removal) is a significant contributor to the differential steam pressure. Thus reduction of pressure loss through the dryer system can contribute to increased energy savings in paper machine drying operations by increasing the entrainment ratio of the thermo compressor and reducing the blow down potential.

To maintain the rimming depth of condensate at its optimum depth (generally about 1/16" for efficient heat transfer), the condensate must be removed from the dryer can through the syphon at the same rate as it is formed. If this is not achieved the rimming depth will increase and the dryer will flood and become inoperable. Dryer drums rotate at significant angular velocity and the resulting centrifugal force maintains the condensate in a rimming condition on the inside face of the drum. Removal of condensate from the drum requires overcoming the centrifugal force tending to prevent the flow of the steam condensate mixture toward the axis of rotation and of course frictional forces.

Many different types of condensate removal shoes have been used. In each case the condensate is forced into the shoe and through the condensate return pipe via the pressure difference between the steam pressure inside of the drum and in the separator tank.

Dryer shoes having internal plates or baffles to redirect the flow of steam and condensate entering the shoe in an axial or circumferential direction to a direction substantially perpendicular thereto are known. Examples of such devices are shown in U.S. Pat. Nos. 4,384,412 issued May 24, 1983 to Chance et al. or 4,516,334 issued May 14, 1985 to Wanke or 4,718,177 issued Jan. 1, 1988 to Haeszher et al.

U.S. Pat. No. 4,606,136 issued Aug. 19, 1986 to Pflug discloses a rotary syphon system wherein the transition between the inlet gap and outlet conduit is relatively smooth and the area of the transition passage is maintained substantially constant. To offset any tendency of the shoe to flood, additional steam is admitted to an internal chamber through ports holding the inner transition piece to the outer shoe. Steam enters these ports and appears as blow through steam at the separator tank of the dryer section regardless of whether any of the cans in the dryer section is flooded.

None of these devices nor any of the dryer syphon shoes of which applicant is aware address the shoe perimeter and clearance required to maintain efficient heat transfer in a dryer can nor the use of distributed flow in transporting the condensate through the syphon, i.e. the cross sectional area of the required passage through the syphon to convey the steam and condensate from the shoe perimeter to the exit pipe under distributed flow conditions.

None of these devices nor any syphon shoes of which applicant is aware coordinate the syphon inlet gap dimensions with the conditions within the dryer section to obtain distributed flow of condensate and steam entering the syphon from the drum so that the ratio of steam to condensate removed from the system through the gap is that required to obtain distributed flow using a minimum excess of steam (plus a factor of safety). Distributed flow lowers the pressure drop needed to convey the condensate from the perimeter of the drum (rim) to the axis of rotation.

There is a plethora of terms used in the literature to describe the various types of flow regimes that may be encountered in bi-phase flow. The definition of "segregated" versus "distributed" flow as used herein are as follows:

Segregated flows: flows where the liquid and gas phases are both essentially contiguous in the axial direction. Types of such flow are annular, crescent, wavy, stratified, etc.

Distributed flows: flows where one phase is continuous and the other dispersed to one degree or another. This flow type includes dispersed flow (liquid distributed in vapour), bubble flow (vapour in liquid), froth flow, etc.

The concept of distributed flow of steam and water has been investigated and reported upon for example by A. E. Dukler in a book entitled "Gas-Liquid in Pipelines, 1. Research Results" dated May, 1969 produced for the American Gas Association, Inc., University of Houston and the American Petroleum Institute. Dukler has developed a model for predicting flow regime transition in horizontal and near horizontal gas liquid flows. See 'A Model for Predicting Regime Transition in Horizontal and Near Horizontal Gas-Liquid' AIChE Journal (Vol., No. 1), January, 1976, pages 47–54 inclusive by Taitel and Dukler of the Department of Chemical Engineering, University of Houston.

Beggs et al. in 'A Study of Two-Phase Flow in Inclined Pipes' published in the Journal of Petroleum Technology in May, 1973, pages 607–617 teaches how to determine pressure drop and liquid hold-up of two phase gas liquid flows in inclined pipes. These teachings were of particular interest to the petroleum, chemical and nuclear industries and were developed for predicting the flows of such chemicals.

BRIEF DESCRIPTION OF THE PRESENT INVENTION

It is an object of the present invention to provide a dryer syphon structure wherein distributed flow of steam and condensate is attained throughout the condensate syphon return system using a low ratio of steam to condensate and thereby permitting reducing the pressure drop across the system.

Broadly the present invention relates to a dryer syphon for withdrawal of condensate from a steam heated drum having an outside shell comprising a shoe mounted in said dryer, said shoe having a condensate and steam inlet gap defined on one side by a lip on said shoe and on the other side by an inside surface said shell of said drum, said gap having a preselected area ($a_p$), said area being defined by a perimeter ($P_a$) of said gap and a spacing (t) between said inside surface of said shell and an inside surface of said lip on said shoe, said perimeter being correlated with the design rimming thickness (Y) of condensate rimming said dryer drum when said dryer drum is operating under its maximum design conditions, and said spacing accommodating flow of condensate and of steam from the interior of said drum into said gap in a ratio of condensate to steam entering said syphon to produce distributed flow of said steam and said condensate on entering said syphon under maximum condensate flow design conditions, a transition passage extending from said gap to a conduit, said passage maintaining substantially the same cross sectional area measured perpendicular to the direction of steam and condensate flow therethrough, said cross sectional area being not greater than the area of said gap and said condensate return pipe having a cross sectional area substantially the same as said cross sectional area of said passage whereby distributed flow of said steam and said condensate is maintained throughout said syphon system to carry said condensate from said dryer drum.

Preferably the area ($a_p$) and said perimeter ($P_G$) and spacing (t) are coordinated with the size and conditions in said dryer drum to insure a modified Froude number (F) for flow through the gap of greater than 0.5.

Preferably the perimeter $P_G$ of said gap will be no smaller than and not more than 10% greater than the percents determined by the formula $$P_G = \left( \frac{P_d^{0.324}}{2.42S} \sqrt{\frac{R}{Y^3}} \right) A \tag{22}$$

where $P_G$=perimeter of gap - in.

$P_g$=design steam pressure to the drum - psig

R=Radius of the inside surface 74 of drum - ft.

S=peripheral speed of the shell 22 - ft/min

A=Area of perimeter of dryer can - sq. ft.

Preferably the spacing (t) will be within 10% of the depth of condensate rimming said drum when said dryer is operated under design conditions.

Preferably perimeter of said dryer syphon gap will extend around the complete circumference of said shoe.

Most preferably the circumference of said shoe will be substantially rectangular with a pair of opposed sides of the rectangle substantially parallel to the axis of rotation of said drum.

Preferably one side of said passage will be defined by an inner surface on said shoe and an opposite side will be formed by an outer surface of a shoe plate received within said shoe.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
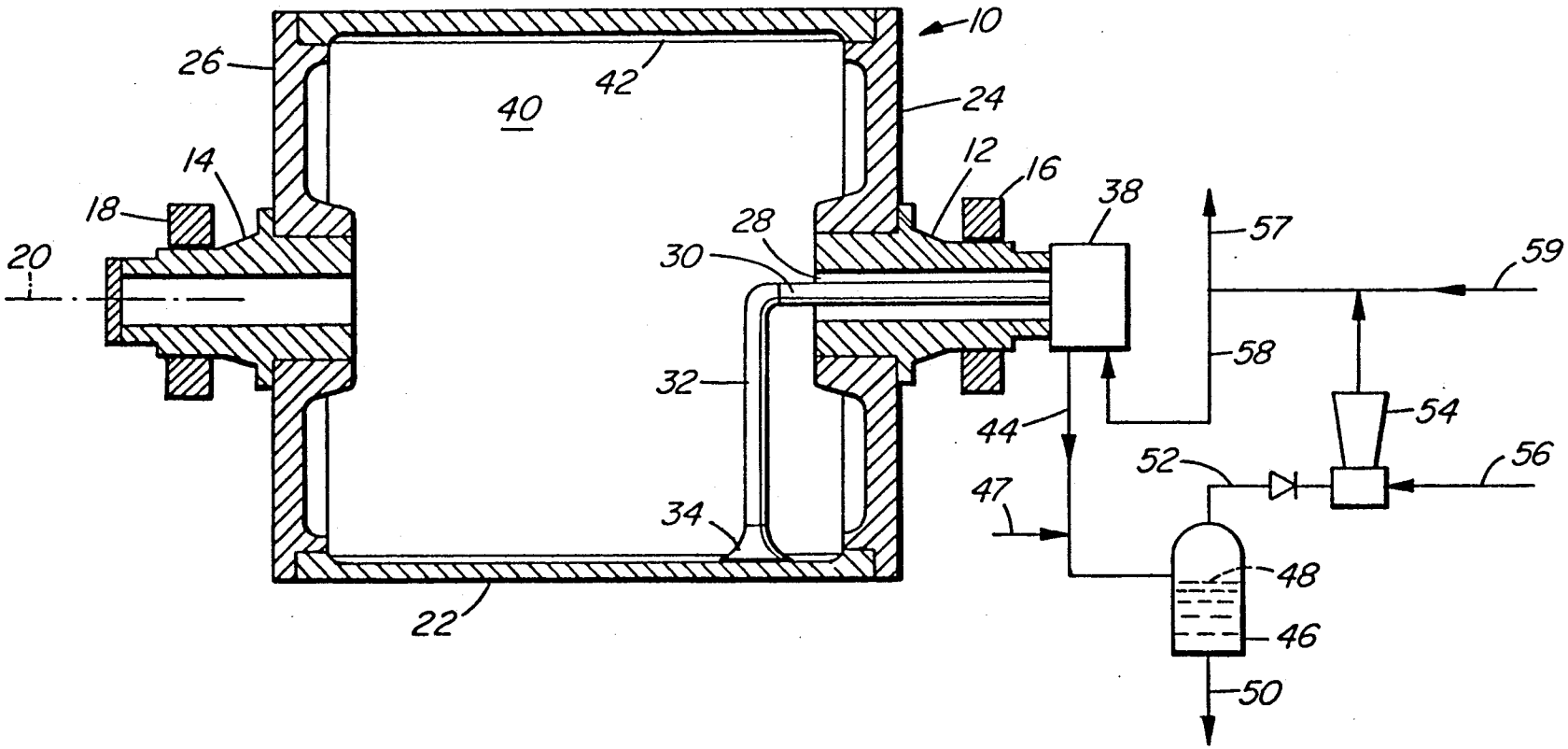
FIG. 1 is a schematic section through a typical dryer drum showing a rotary syphon in position.
Figure 2:
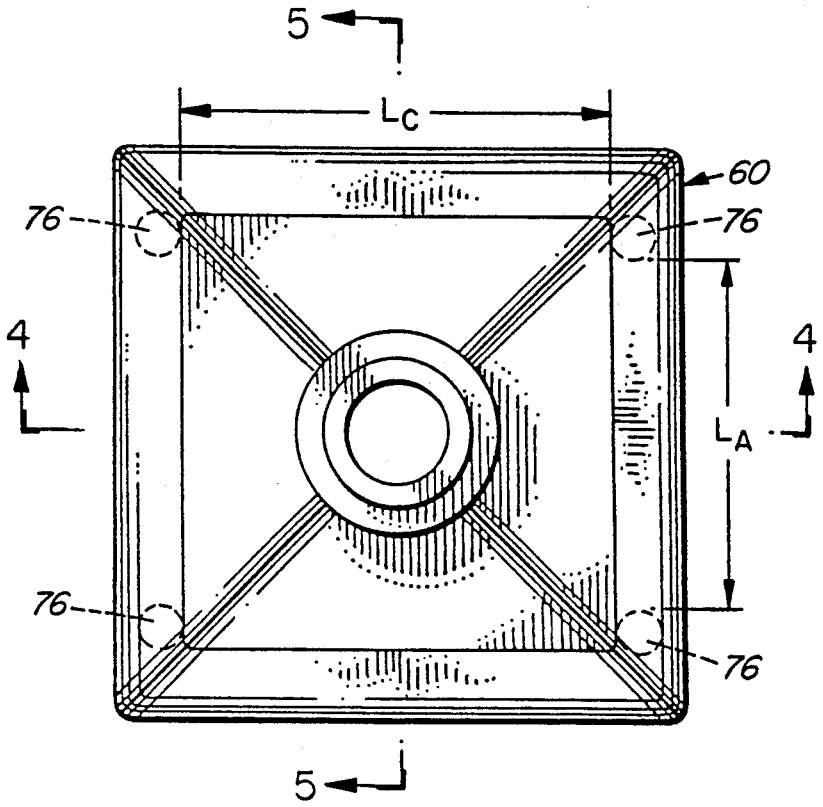
FIG. 2 is a plan view of a rotary syphon shoe constructed in accordance with the present invention.

Figure 1 shows a typical dryer drum configuration wherein the dryer drum 10 is mounted on a pair of journals 12 and 14 which rotate in suitable bearings 16 and 18 around the axis 20. The cylindrical shell 22 forming drying surface of the drum is supported from the journals 12 and 14 by heads 24 and 26 respectively.

At least one of the journals 12 or 14 is hollow, i.e. is provided with a longitudinal passage such as the passage 28 in the journal 12. Contained within this axial passage 28 is a syphon return pipe 30 that is connected to a substantially radial conduit leg 32 which in turn connects to the dryer syphon shoe 34. The pipe 30, leg 32 and shoe 34 rotate with the drum 10 and thus a suitable gland or the like 38 is used to connect the pipe 30 and passage 28 (surrounding the pipe 30) to a condensate return system and a live steam injection system respectively.

In operation live steam is injected into the interior 40 of the drum 10 through passage 28 from the gland 38 and heats the drying surface of the shell 22 to form a layer of condensate 42 that is held in rimming relationship to the drum shell 22 by centrifugal force. The thickness of this rimming layer of condensate has been indicated as Y.

Condensate from this rimming layer 42 enters the syphon shoe 34, is carried up through the leg 32 and pipe 30 and is withdrawn from the system as indicated by the arrow 44 and directed to a condensate tank 46 containing condensate up to a level 48 and having a steam filled space thereabove. The pressure in tank 46 is less than the pressure in the interior 40 of the drum. Condensate from the tank 46 is returned to the boiler as indicated by the arrow 50 and steam from the tank 46 passes via line 52 to a thermo compressor or the like 54 into which live steam is injected as indicated by the arrow 56 and provides the steam entering the chamber 40 through the passage 28 as indicated by the arrow 58. Make up steam is supplied as indicated by the arrow 59.

In the illustrated arrangement a single dryer drum has been illustrated however, the condensate from a whole dryer section (about 10–24 drums) will normally be directed to the same condensate tank 46 as indicated by line 47 and the line 58 will be branched to inject steam into all of the dryer drums in the section as indicated by the arrow 57 so that the pressure inside each dryer drum in the section will be substantially the same and the pressure drop as determined by differences in pressure between the interior 40 of the dryers and the pressure in the tank 46 will also be the same for each dryer in the section.

A preferred syphon shoe constructed in accordance with the present invention is illustrated in FIGS. 2 to 5 inclusive. This syphon is particularly suited to high machine speeds (drum speeds) of 3000 ft. per minute and over. The syphon shoe 34 is composed of two main elements; the outer housing 60 and an inner shoe plate 62 shown in plan view in FIGS. 2 and 3 respectively and in a section in assembled relation in FIGS. 4 and 5. The housing 60 connects with leg 32 and is provided with an internal surface 64 that defines the outside of an annular passage 66 leading from a peripheral syphon inlet gap 68 wherein the condensate and steam enters the syphon in a direction substantially axially and/or circumferentially of the drum and directs the flow into a substantially radial passage section 70 substantially radial to the axis 20 emptying into the return pipe or leg 32.

The opposite wall of the passage 66 to the wall formed by the surface 64 is formed by an annular surface 72 on the plate 62. The cross sectional area of the passage 66 measured perpendicular to the direction of flow of condensate and steam throughout the full length of the passage 66 from gap 68 to leg 32 including section 70 must be coordinated with the area of the inlet 68 and both of which must be specifically sized to obtain distributed flow of steam and condensate through the shoe 34 and out of the dryer drum 10, if the benefits of the present invention are to be obtained. The sizing of the inlet 68 thus of the passage 66 and the leg 32 and conduit 30 are important to the invention and will be described in more detail hereinbelow.

Figure 3:
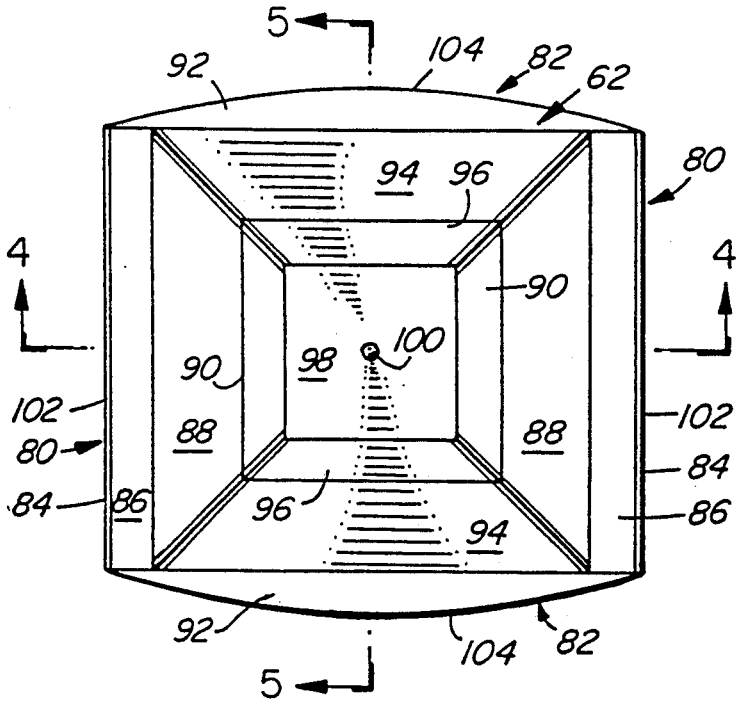
FIG. 3 is a plan view of a base plate adapted to be received within the shoe of FIG. 2.
Figure 4:
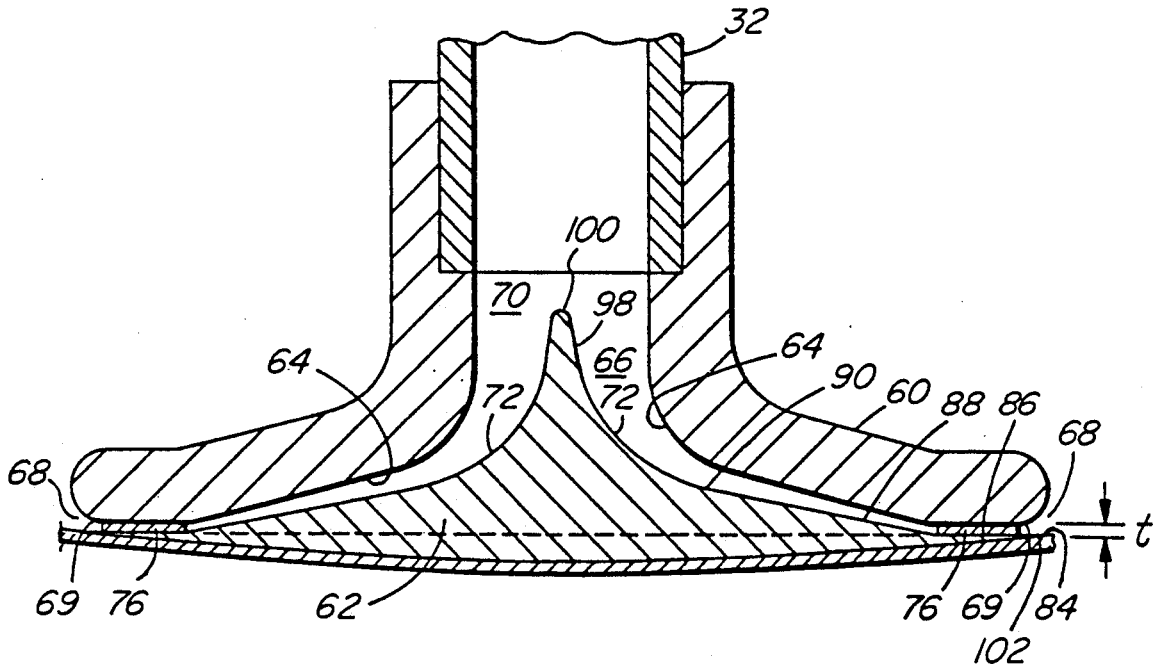
FIG. 4 is a section along the line 4—4 of FIG. 2 or 3 showing the syphon shoe with the base plate received therein mounted in position in a dryer drum.
Figure 5:
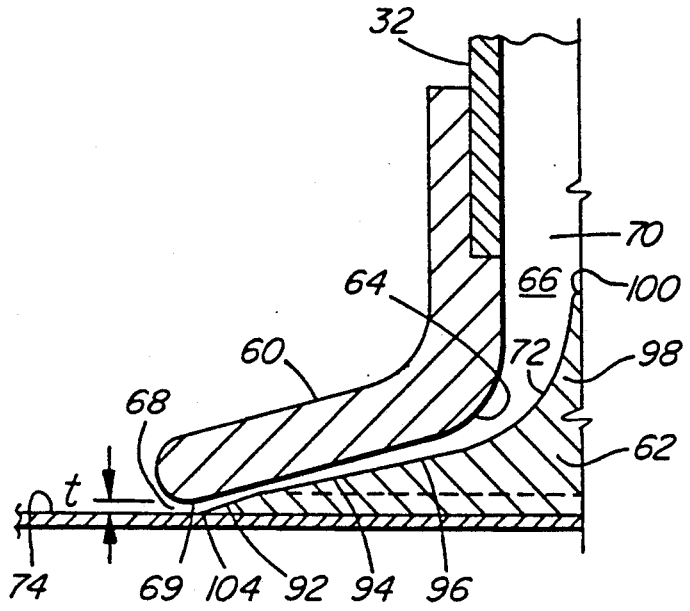
FIG. 5 is a view similar to FIG. 4 but taken along the lines 5—5 of FIGS. 2 and 3 and showing only half of the dryer syphon.

In the arrangement shown in FIGS. 2–5 inclusive, the height of the inlet, i.e. clearance between the inner surface 64 of the lip 69 of the housing 60 at the gap 68 and the opposed surface 72 of plate 62 at the inlet 68 or between the surface 64 at lip 69 and the inner surface 74 of the drum shell 22 which is indicated by the dimension t in FIGS. 4 and 5. This clearance t is defined by the length of the feet 76 (see dotted lines in FIG. 2 and FIG. 4). In the illustrated shoe there is one foot 76 positioned in each corner of the shoe.

The perimeter of the inlet is the open length of the gap 68. In the embodiment of FIGS. 2 to 5 the perimeter has a pair of opposite portions measured axially of the drum indicated by $L_A$ between a pair of adjacent feet 76 at one pair of opposite sides of shoe 34 and a second pair of opposite portions measured circumferentially of the shoe, (i.e. perpendicular to the one pair of sides) as indicated by the dimension $L_C$ in FIG. 2. Thus the perimeter of the gap ($P_G$) is determined by the formula $$P_G=2(L_A+L_C)$$

and the total area of the inlet ($a_p$) to the shoe 34 is substantially equivalent to $$a_p=2t(L_A+L_C)=t\,P_G \quad (24)$$

The dimensions of the inlet 68 as above indicated are important to this invention and will be described in further detail below.

As shown in FIG. 3 the shoe plate 62 has two pairs of opposed substantially similar surfaces indicated at 80 and 82 respectively which conform with the axially extending length $L_A$ of the shoe 34 and the circumference extending length $L_t$ of the shoe 34. Each of the surfaces 80 is formed by a plurality of intersecting planar sections 84, 86, 88 and 90. Similarly each of the surfaces 82 is formed by intersecting adjacent planar sections 92, 94, and 96 corresponding with surfaces 86, 88 and 90 respectively of surfaces 80. The pair of surfaces 80 and 82 then combine to form a substantially convex conical surface 98 that terminates in a rounded dome 100.

It will be apparent that the outer edge 102 of the sides 80 are substantially straight whereas the outer edge of the sides 82 are convex as indicated at 104 to conform with the inside diameter of the drum shell 22.

The above construction of the shoe plate 62 simplifies machining in that the surface 103 that conforms with the inside of the drum shell 22 and can easily be machined by cutting at a radius equivalent to the inner diameter of the shell. The various planer surfaces forming the surfaces 80 and 82 are also easily machined as is the conical section 98 thereby facilitating manufacture of the base plate unit 62. The configuration of the wall 64 will be coordinated with the surfaces 80 and 82 to maintain the cross sectional area of the passage 66 substantially constant.

Figure 6:
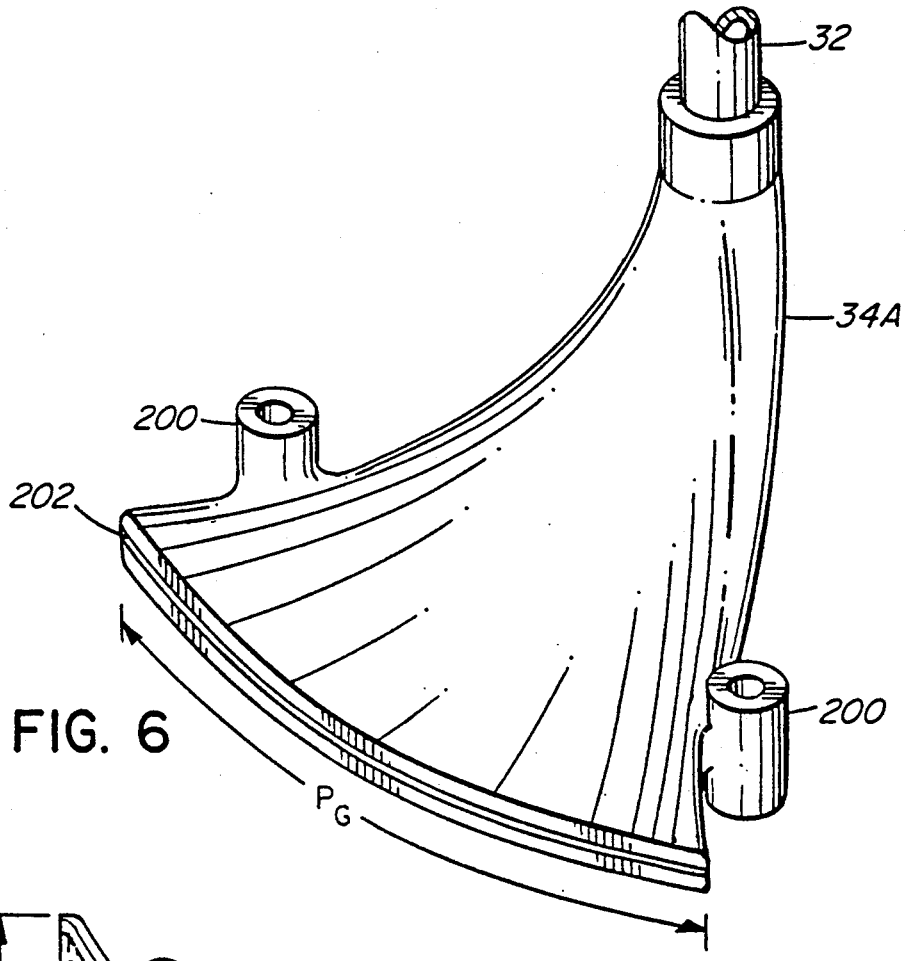
FIG. 6 is an illustration of a modified form of shoe that may be mounted at one axial end of a dryer drum.
Figure 7:
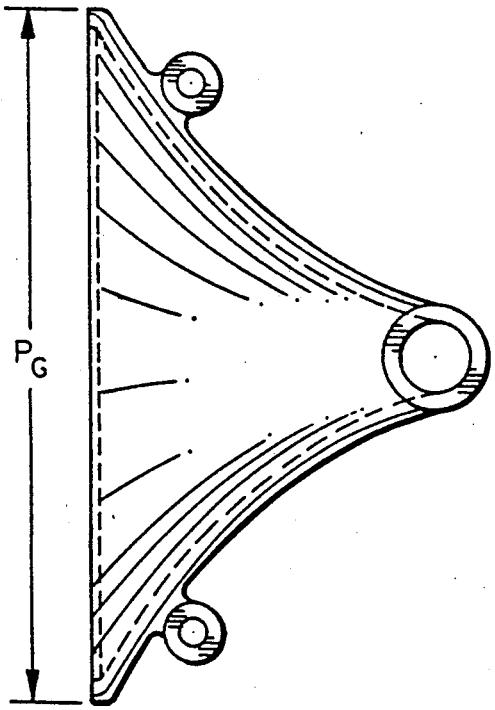
FIG. 7 is a planned view of the shoe of FIG. 6.
Figure 8:
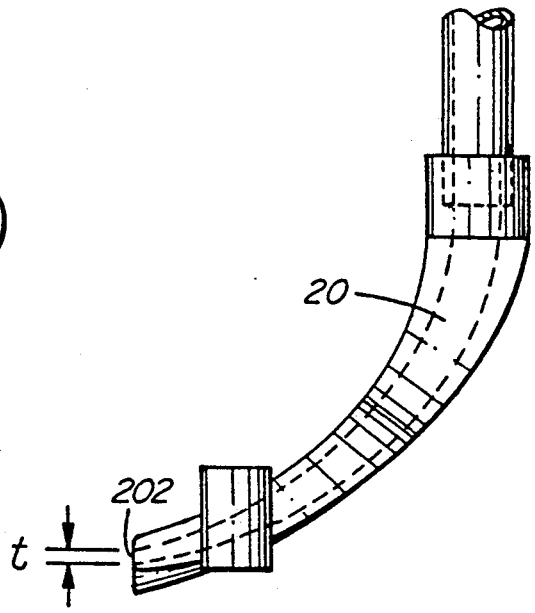
FIG. 8 is a side view of the shoe of FIG. 6.

While the shoe has been shown as square in plan, it will be apparent that other shapes may be used, for example instead of being square the shoe may be circular or oval or may take on a configuration such as that shown in FIGS. 6 to 8 inclusive.

A syphon shoe illustrated in FIGS. 6–8 will be mounted adjacent one axial end of the dryer drum 10, i.e. probably adjacent the head 24 and will have its inlet facing toward the opposite head 26.

The modified shoe 34A is connected to the leg 32 as above described and is secured in position in the drum 10 via bolts (not shown) extending through suitable mounting brackets 200 one at each side of the shoe 34A.

The shoe 34A has a an inlet opening 202 substantially equivalent to the inlet 68 with the height (t) of the inlet opening 202 being substantially the same as that of the inlet 68 and indicated by the same dimension t. Similarly the perimeter or an effective length of the inlet 202 indicated by the length $P_G$ in FIG. 6 is substantially equivalent to the perimeter $P_G$ described above, i.e. the effective inlet length. A passage 204 extends from the inlet 202 to the pipe or leg 32 and is dimension to contract in one plane and expand in another while maintaining the cross sectional area of the passage 204 measured perpendicular to the direction of steam and condensate flow therethrough substantially equal to the area of the inlet 202 in the same manner as the areas of the passage 66 and the inlet 68 are coordinated.

To practice the present invention as above indicated it is essential to ensure that there is distributed flow through the shoe 34 (34A) and conduits 32 and 30 to facilitate removal of the condensate from the system and reduce the energy required to convey the condensate (minimize the pressure drop across the system necessary to convey the condensate) from the drum. It is well known that distributed flow is more efficient as it develops less 'hold up' in the system. Energy loss is directly proportional to hold up thus the smaller the "hold up" in the system the less energy that need be consumed. The term "hold up" designates the fractional volume of flow of condensate and steam occupied by condensate.

Taitel and Dukler in the above referred to article entitled 'A Model for Predicting Flow Regime Transitions in Horizontal and Near Horizontal Gas-Liquid Flow' define a modified Froude number (F) that may be used to determine the bi-phase flow regime when the Martinelli parameter ($X_M$) is less than 1.6.

$$F\left(\frac{M_G}{M_L - M_G}\right)^{\frac{1}{2}} \times \frac{V_{SG}}{\sqrt{Dg}} \quad (1)$$

where

M=density - lb/ft.$^3$

D=pipe diameter - ft.

g=gravitational acceln - ft/sec.$^2$

F=two phase Froude Number $V_s$=superficial velocity for single fluid - ft/sec.

subscript G=gas phase subscript L=liquid phase

To convert this relationship defined in equation (1) into terminology commonly used in the operation of paper machines wherein a=area for flow of steam and condensate through the syphon - in$^2$ A=surface area of dryer can - ft.$^2$ $B_S$=% steam blow through - %

C=condensate flow - 1; b/h f=ratio of actual condensate flow to maximum condensate blow at the selected steam pressure F=Dukler's modified Froude No. defined above (equation (1))

$P_d$=Pressure of steam to dryer can - psig

R=Radius of dryer can - ft.

S=paper machine (m/c) speed - fpm.

S=specific volume of condensate - ft$^3$/lb.

$S_s$=specific volume of steam - ft$^3$/lb.

$T_s$saturated steam temperature - ° F. at pressure of $P_d$ - psig $C_u$=unit condensate flow - lb/h. ft$^2$ of dryer surface X=steam flow - lb/h.

From the above it follows that $$M_G = 1/S_s \quad (2)$$

$$M_L = 1/S_c \quad (3)$$

$$g' = S^2/(3600 \times R) = \text{effective gravitational acceln} - \text{ft/sec.}^2 \quad (4)$$

By definition ÷ (5)

$$\text{Steam blow through (\%) } B_s = \frac{100 \times X}{c + X}$$

$$\therefore X = J \times C \quad (6)$$

where $J = Bs/(100 - Bs)$ dimensionless $$C = C_u \times A - \text{lb/h} \quad (7)$$

$$C_u = f \times C_{umax} - \text{lb/h:ft} \quad (8)$$

where $C_{umax} = 0.035\ T_s - 4.9$ (from well known *TAPPI* and *CPPA* design data)

$$D = \sqrt{4a/\pi/12} - \text{ft} \quad (9)$$

$$V_{SG} = (J \times f \times A \times C_{umax} \times S_s \times 144)/(3600 \times a) - \text{ft/sec.} \quad (10)$$

Equation (1) may be simplified to $$F = \frac{7.3 \times n \times J \times f \times A \times \sqrt{R}}{a^{1.25} \times S} \quad (11)$$

$$\text{where } n = \sqrt{S_c/(S_s - S_c)} \times C_{umax} \times S_s$$

For $P_d$ over the range of 15–75 psig (the active range in which paper machine dryers are normally operated) the value of n was calculated and found to vary from 1.86 to 1.89 and thus for practical purposes the value n will be considered as a constant.

$$n = 1.89$$

$$\text{thus } F = \frac{14.79 \times J \times f \times A \times \sqrt{R}}{a^{1.25} \times S} \quad (12)$$

$$\text{or } a = 8.63\left(\frac{fJ\sqrt{R}}{FS} \times A\right)^{0.8} \quad (13)$$

It is important that the modified Froude No. F for flow through the syphon be greater than 0.5 (preferably 1.0) to ensure distributed flow.

Having determined the area a for the passage 66 it is then necessary to determine the dimension of the inlet 68 in particular the perimeter $P_G$ and the height of the gap t. The terms used to derive the size of the opening 68 are as Y=rimming depth of condensate in dryer can - in Y=critical depth of condensate in dryer can - in t=height of the gap - in $P_G$=shoe perimeter - in $V_c$=condensate velocity - fps $Q_c$=condensate flow - cfs Other terms as defined hereinabove.

The flow of condensate into the shoe will always be tranquil thus the depth of condensate under design conditions will never be less than critical depth $Y_c$ and normally will be close to $Y_c$. For practical purposes assume that condensate depth at the inlet to the syphon shoe is equal to $Y_c$ and the condensate Froude No. for flow of condensate into the syphon is unity (1) and:

$$V_c^2 = g^1 \times Y_c/12 \quad (14)$$

where $g^1 = S^2/(3600 \times R)$ = effective gravitational accel$^n$ – ft/sec $$V_c = 144 \times Q_c/P_G \times Y_c \text{ – ft/sec.} \quad (15)$$

$$Q_c = C \times S_c/3600 \text{ – cfs.} \quad (16)$$

$$C = f \times C_{umax} \times A \text{ – lb/h} \quad (17)$$

$C_{umax} = 0.035\ T_S - 4.9$ – lb/h.ft (as above)

substituting these values in equation 14 gives:

$$P_G = \frac{8.314 \times f \times C_{umax} \times S_c \times A}{S} \sqrt{\frac{R}{Y_c^3}} \quad (18)$$

It is known that $$Y \text{ is about equal to } 1.5\ Y_c \quad (19)$$

$$P_G = \frac{15.274 \times f \times C_{umax} \times S_c \times A}{S} \times \sqrt{\frac{R}{Y^3}} \quad (20)$$

The expression $C_{umax} \times S_c$ is dependent only on the steam pressure to the dryer $P_d$ and has been found to correlate within 1% with the equation:

$$C_{umax} \times S_c = \frac{P_d^{0.324}}{36.9} \quad (21)$$

$$P_G = \frac{f \times P_d^{0.324}}{2.4 \times S} \times \sqrt{\frac{R}{Y^3}}\ A \quad (22)$$

$$\text{or } Y = \frac{f \times P_d^{0.324} \times \sqrt{R}}{2.4 \times S \times (P_G/A)}^{\frac{2}{3}} \quad (23)$$

Thus the perimeter $P_G$ of the inlet 68 is defined based on the condition that exist to handle the condensate flow at critical depth $Y_c$. It is now necessary to determine the required cross sectional area for distributed flow of condensate and steam through the syphon under the condition existing in the dryer section.

To determine the design of a shoe the following symbols are used to represent the criteria designated (where possible the same symbols have been used as were used hereinabove).

Symbols a=area for flow of condensate and steam through shoe in$^2$ $a_p$=area for flow of condensate and steam at perimeter in$^2$ t=shoe clearance at perimeter - in.

Y=rimming depth of condensate - in.

The suffix 'des' has been used to designate specific design conditions for a specific application.

$$a_p = P_G \times t \quad (24)$$

and $a_p$ is not less than area a and not more than about 10% greater than area a since distributed flow must be maintained throughout the syphon return system in the drum without excessive blow by of steam. If t is too large, blow through steam will be excessive. A similar condition pertains if the perimeter $P_G$ is too large. Up to about 30% blow through steam may be acceptable depending on the installation, however the amount of blow through steam should, for most steam efficient operations, be equal to or slightly greater than that required to obtain distributed flow.

For maintaining distributed flow through the shoe $$a = 8.63 \left( \frac{fJ\sqrt{R}}{FS} \times A \right)^{0.8} \quad (13)$$

At design conditions, and condensate flow is at a maximum and therefore f=1

$$a_{des} = 8.63 \left( \frac{J_{des}\sqrt{R}}{F_{des} \times S_{des}} \times A \right)^{0.8} \quad (13\text{ des})$$

$$a_{des} = K \times A^{0.8}$$

$$\text{where } K = 8.63 \left( \frac{J_{des}\sqrt{R}}{F_{des} \times S_{des}} \right)^{0.8}$$

The threshold value of F is 0.5, i.e. F must be at least 0.5 if the condensate and steam are to flow in a distributed flow regime.

For other conditions than design:

$$F = \frac{14.792 \times f \times A \times J \times \sqrt{R}}{(a_{des})^{1.25} \times S} \quad (25)$$

$$\frac{F2}{F1} = \frac{f_2 \times J_2}{f_1 \times J_1} \times \frac{S_1}{S_2} \quad (26)$$

If speed is reduced ($S_2 < S_1$) the steam pressure and diff pressure are also reduced, and $f_2 \times J_2$ is about equal to $f_1 \times J_1$ thus the Froude No. tends to increase and distributed flow will be maintained when speed is reduced.

For accessing the shoe perimeter:

$$P_G = \left( \frac{f \times P_d^{0.324}}{2.416 \times S} \times \sqrt{\frac{R}{Y^3}} \right) A \quad (22)$$

At design conditions, as above condensate flow is maximum and f=1

$$P_{Gdes} = \left( \frac{P_{ddes}^{0.324}}{2.4 \times S_{des}} \times \sqrt{\frac{R}{Y_{des}^3}} \right) A \quad (22\text{ des})$$

For other conditions than design:

$$Y = \left( \frac{f \times P_d^{0.324} \times \sqrt{R}}{2.4 \times S \times (P_{Gdes}/A)} \right)^{\frac{2}{3}} \quad (27)$$

-continued $$\frac{Y_2}{Y_1} = \left( \frac{f_2 \times P_{d2}^{0.324}}{f_1 \times P_{d1}^{0.324}} \times \frac{S1}{S2} \right)^{\frac{1}{3}} \quad (28)$$

If speed is reduced (S2<S1) and steam pressure and differential pressure are also reduced. These effects tend to cancel each other out and maintain the same rimming depth. If anything Y might tend to be slightly decreased.

It is necessary to determine the perimeter $P_G$ and the required area $a_p$ when practising the present invention, which requires determining the conditions of the shoe at its perimeter (inlet 68). In turn, to determine these conditions, in particular the depth of condensate, etc., requires further analyses. For this analysis the following further terms are Y=rimming depth of condensate which is equivalent to the depth at a distance L from shoe perimeter $Y_p$=depth of condensate at perimeter of shoe It is known that $Y_p$ will not be less than $Y_c$ and normally will be about equal to Yc where, as above described, Yc=critical depth and occurs when Froude No.=1.

$$\text{Froude No.} = V/\sqrt{gY/12} \quad (14)$$

$$\text{thus} \div Vcc = \sqrt{g_1 Yc/12}$$

where $V_{cc}$=velocity of condensate at critical depth g=arc of gravity

Based on the conditions described above and the concept of energy conservation $$\frac{Y}{12} + \frac{V_{cy}^2}{2g^1} = \frac{Y_c}{12} + \frac{V_{cc}^2}{2g^1} + E_f \quad (29)$$

where $V_{cy}$=velocity of condensate at depth Y $E_f$=energy lost in friction.

Equation 29 can be simplified by substitution to $$\frac{Y}{12} + \frac{V_{cy}^2}{2g^1} = 1.5\frac{Y_c}{12} + E_f \quad (30)$$

$E_f$ may be ignored as it is very small. Y is normally in the order of 1/16 inch and the axial length L of the drum is normally greater than 100 inches, thus the ratio L/Y is very large and $V_{cY}$ must be very small. Therefore the term $Vcy^2/2$ g may also be ignored. Thus Y cannot exceed 1.5 Yc. Thus it is clear that (a) $Y_p < Y$ (b) $Y_p \geqq Y_c$ (c) $Y \leqq 1.5\ Y_c$ and t must be >Yc to provide an area large enough to obtain the required ratio of steam to condensate for distributed flow but not so large as to permit the escape of too much excess steam.

In general if t is set to be about equal to Y then all conditions are satisfied.

The Martinelli parameter ($X_M$) referred to above is given by $$X_M = \frac{1}{J}\sqrt{\frac{S_c \times f_c}{S_s \times f_s}} \quad (31)$$

$f_c$=friction factor for superficial condensate flow $f_s$=friction factor for superficial condensate flow correlation of $f_c$, $f_s$ and $B_s$ (blow through) shows that ÷

$f_c/f_s$ is about equal to H+N ln $B_s$ (32)

$P_d$=steam pressure to dryer can in psig

With a $P_d$ in the range of 15–75 psig and blow through in the range of 10% to 35% the Martinelli parameter ($X_M$) will be in the range of 0.1 to 0.6. This covers most cases for paper machines operating with rotary syphons. Bi-phase flow in typical paper machine syphon systems ÷

1. Does not occur in the intermittent regime, i.e. does not occur where $X_M > 1.6$.
2. Requires a Dukler Froude No. F in excess of a threshold value of 0.5 to maintain distributed (annular-dispersed liquid) as opposed to segregated (stabilized wavy) flow.

EXAMPLE

In a typical dryer having an axial length of 312 inches and a diameter of 6 feet operating at 400 feet per minute with a condensate depth of 1/16 of an inch the calculated periphery or length of the periphery for a gap height t of 1/16 inch was as follows:

| Steam Pressure - Pd (psig) | Perimeter PG - inches | Selected Perimeter - inches |
|---|---|---|
| 15 | 19.2 | 20 |
| 35 | 25.3 | 27 |
| 55 | 29.3 | 31 |
| 75 | 32.4 | 35 |

It will be noted that at 15 psig the perimeter selected was about 20 inches slightly larger than the calculated 19.2. Similarly, at 55 psig, steam pressure entering the dryer calculated at the perimeter was 29.3 inches, and a perimeter of 31 inches was selected, again slightly larger than the actual calculated value.

It is important that the perimeter not be significantly less than calculated value but slightly greater than the calculated value is acceptable to better ensure distributed flow, however as the perimeter is increased, the blow through steam also increases so that if the perimeter is made too large the effectiveness of the system will be lost due to excessive blow through.

Having described the invention modifications will be evident to those skilled in the art without department from the spirit of the invention as defined in the appended claims.

We claim:

1. A dryer syphon for withdrawal of condensate from a steam heated drum having an outside shell mounted for rotation about an axis of rotation comprising a shoe mounted in said dryer, an inner shoe plate within and concentric with said shoe, said shoe having a condensate and steam inlet gap defined on one side by a lip on said shoe and on the other side by an inside surface said shell of said drum, said gap having a preselected area ($a_p$), said area being defined by a perimeter ($P_G$) of said gap and a spacing (t) between said inside surface of said shell and an inside surface of said lip on said shoe, said perimeter $P_G$ and said spacing (t) being correlated with rimming depth (Y) of condensate rimming said dryer drum when said dryer drum is operating under its preselected maximum operating conditions, said perimeter $P_G$ and said spacing (t) being relatively dimensioned to accomodate flow of condensate and of steam from the interior of said drum into said gap in a ratio of condensate to steam entering said syphon so that distributed flow of said steam and said condensate is produced in said gap under maximum condensate flow into said syphon at said preselected maximum operating conditions with substantially a minimum amount of said steam required to produce distributed flow entering said gap, a transition passage extending from said gap to a conduit, said passage having throughout its length a substantially constant cross sectional area measured perpendicular to the direction of steam and condensate flow therethrough, said cross sectional area being not significantly greater than the area of said gap ($a_p$), said transition passage being defined by an inside surface on said shoe and an outside surface of said inner shoe plate, said inside and outside surfaces defining a smooth transition for distributed flow of said steam and condensate from a flow entering said gap around said periphery in a direction substantially parallel to said inside surface of said shell to a flow in a direction toward said axis or rotation and said conduit having a cross sectional area substantially the same as said cross sectional area of said passage whereby distributed flow of said steam and said condensate is maintained throughout their passage through said syphon to carry said condensate under distributed flow conditions from said dryer drum.

2. A dryer syphon as defined in claim 1 wherein said area ($a_p$) and said perimeter ($P_G$) and spacing (t) are coordinated with the size and conditions in said dryer drum to insure a modified Froude number (F) for flow through the gap of greater than 0.5.

3. A dryer syphon as defined in claim 2 wherein said modified Froude number (F) is at least 1.

4. A dryer syphon as defined in claim 1 where said perimeter $P_G$) of said gap is at least equal to and not more than 10% greater than the perimeter determined by the formula $$P_G = \frac{P_d^{0.324}}{2.4S} \times \sqrt{\frac{R}{Y^3}} \times A$$

where $P_G$=perimeter of gap - in.
$P_d$ =design steam pressure to the drum - psig
R=Radius of the inside surface of drum - ft.
S=peripheral speed of the dryer drum - ft/min
A=Surface area of perimeter of dryer drum - ft.$^2$

5. A dryer syphon as defined in claim 3 where said perimeter $P_G$ of said gap is at least equal to and not more than 10% greater than the perimeter determined by the formula $$P_G = \frac{P_d^{0.324}}{2.4S} \times \sqrt{\frac{R}{Y^3}} \times A$$

where $P_G$=perimeter of gap - in.
$P_d$=design steam pressure to the drum - psig
R=Radius of the inside surface of drum - ft.
S=peripheral speed of the dryer drum - ft/min
A=Surface area of perimeter of dryer drum - ft.$^2$

6. A dryer syphon as defined in claim 3 wherein said spacing (t) is within 10% of the depth (Y) of condensate rimming said drum.

7. A dryer syphon as defined in claim 4 wherein said spacing (t) is within 10% of the depth (Y) of condensate rimming said drum.

8. A dryer syphon as defined in claim 5 wherein said spacing (t) is within 10% of the depth (Y) of condensate rimming said drum.

9. A dryer syphon as defined in claim 8 wherein said perimeter of said dryer syphon gap extends substantially around the complete circumference of said shoe.

10. A dryer as defined in claim 9 wherein said circumference of said shoe is substantially rectangular shape and wherein a pair of opposed sides of said rectangular shape is substantially parallel to the axis of rotation of said drum.

11. A dryer as defined in claim 3 wherein said circumference of said shoe is substantially rectangular shape and wherein a pair of opposed sides of said rectangular shape is substantially parallel to the axis of rotation of said drum.

12. A dryer as defined in claim 5 wherein said circumference of said shoe is substantially rectangular shape and wherein a pair of opposed sides of said rectangular shape is substantially parallel to the axis of rotation of said drum

13. A dryer as defined in claim 17 wherein one side of said passage is defined by an inner surface on said shoe and an opposite side is formed by an outer surface of a shoe plate received within said shoe.

* * * * *